United States Patent [19]

Mercer et al.

[11] Patent Number: 5,015,372

[45] Date of Patent: May 14, 1991

[54] TOXIN CONTAINING PERFORATED ANTIFOULING POLYMER NOZZLE GROMMET

[75] Inventors: William B. Mercer, Annapolis, Md.; Nathan F. Cardarelli; Richard L. Henry, both of Akron, Ohio

[73] Assignee: The United States of America as represented by the Secretary of the Navy, Washington, D.C.

[21] Appl. No.: 476,234

[22] Filed: Feb. 7, 1990

[51] Int. Cl.[5] ..... B63B 59/00

[52] U.S. Cl. ..... 210/170; 43/124; 114/222; 239/602; 239/DIG. 19; 422/6; 422/240

[58] Field of Search ..... 210/170, 764, 198.1; 239/428.5, 602, DIG. 19; 525/43; 106/18.32; 422/6, 240; 43/124; 114/222

[56] References Cited

U.S. PATENT DOCUMENTS

| | | | |
|---|---|---|---|
| 3,198,441 | 8/1965 | Facius | 239/602 |
| 3,350,211 | 10/1967 | Greenwald | 106/18.32 |
| 3,395,530 | 8/1968 | Campbell | 57/149 |
| 3,785,572 | 1/1974 | Arnold et al. | 239/DIG. 19 |
| 4,082,709 | 4/1978 | Dyckman et al. | 525/43 |
| 4,166,111 | 8/1979 | Cardarelli | 424/78 |
| 4,228,614 | 10/1980 | Cardarelli | 43/131 |
| 4,579,665 | 4/1986 | Davis et al. | 210/764 |

FOREIGN PATENT DOCUMENTS

| | | | |
|---|---|---|---|
| 56-34604 | 4/1981 | Japan | 114/222 |
| 59-206512 | 11/1984 | Japan | 43/124 |
| 1156956 | 5/1985 | U.S.S.R. | 114/222 |

OTHER PUBLICATIONS

"Corrosion Technology"-Corrosion Notebook section, Mar. 1965, Article-The Many Faces of Tm, 422-426.

"Polypropylene", Reinhold Publishing Corp. N.Y., 1960, pp. 10,13, 192,193,196-200.

"Plastic Fasteners", Industrial Fasteners Institute, vol. 10, No. 2, May 10, 1955, Silas S. Cathcart.

"Teflon Tetrafluoroethylene Resin Dispersion", Lontz and Happoldt, Industrial and Engineering Chemistry, vol. 44, No. 8, Aug. 1952.

*Primary Examiner*—Robert A. Dawson
*Assistant Examiner*—Joseph Drodge
*Attorney, Agent, or Firm*—Luther A. Marsh; John H. Stowe; Sol Sheinbein

[57] ABSTRACT

An apparatus and method for the elimination of marine fouling of marine mechanisms such as underwater fluid distribution emission systems. A grommet nozzle made of plastic materials containing an antifoulant and having a capability of easy installation forms a basic part of the apparatus. The grommet nozzle of the invention is formed of a polymer or a mixture of polymers containing a material toxic to calcareous marine organisms and capable of release of the toxic material into the environment at such a rate that the marine organisms grow extremely slow, yet the release rate is not sufficiently fast to be a toxic hazard to the surrounding environment.

6 Claims, 3 Drawing Sheets

ONE PIECE
GROMMET

HOLES TO BE
DRILLED OUT FOR
POLYMER GROMMET

INSTALLATION PROCEDURE

TOXIN CONTAINING PERFORATED ANTIFOULING POLYMER NOZZLE GROMMET

The invention described herein may be manufactured and used by or for the Government of the United States of America, for governmental purposes without the payment of any royalties thereon or therefor.

BACKGROUND OF THE INVENTION

1. Field of Invention

This invention relates to the elimination of marine fouling of marine mechanisms and more particularly to the elimination of marine fouling of underwater fluid distribution emission systems and thus maintaining and prolonging the functional life of such systems.

2. Description of the Prior Art

The use of underwater marine underwater fluid emission systems have been in use for many years. The fluid bubbles are usually emitted through small openings in metal or plastic type pipes and placed where needed in an underwater system. Air underwater emission systems are one of the more routinely used systems for aeration, fluid distribution, etc. Any such system initially is extremely efficient. However, such a system tends to foul or become encrusted upon exposure to a water environment, and particularly so upon exposure to a seawater environment. Such fouling or encrustation by the growing organisms results in drastic reduction in the volume rate of fluid emission by the system.

Certain polymer toxicant formulations that are useful in such application are well known as illustrated in U.S. Pat. Nos. 4,166,111 and 4,228,614 issued to Nathan F. Cardarelli. It is also well known to impregnate various types of polymers for subsequent use as an elastomeric coating or impregnation of a rope, strand or core as illustrated in U.S. Pat. No. 3,395,530 issued to Robert Edward Campbell. Applicants have now made a true improvement in this art area, wherein plastic materials containing an antifoulant are specifically designed and used for molding of underwater fluid emitters for use in the elimination of marine fouling of underwater emission systems.

SUMMARY OF THE INVENTION

Accordingly, it is an object of the invention to provide an emission opening in an underwater fluid emission system with a nozzle grommet made of plastic material and containing an antifoulant of various sizes and shapes for use in said opening in said underwater fluid emission system.

Another object of the invention is to provide a nozzle grommet made of plastic materials containing an antifoulant and having a capability of easy installation.

Another object of the invention is to provide a nozzle grommet made of plastic materials containing an antifoulant and having a capability of installation in an emission opening while the underwater fluid emission system is waterborne.

Still another object of the invention is to provide a nozzle grommet made of plastic materials containing an antifoulant and having a capability of maintaining its shape and remain in position against the forces which tend to remove it, such as, pressure, water flow and gravity.

A further object of the invention is to provide said nozzle grommet that can be geometrically different and can be of a one piece or a two piece design.

A sill further object of the invention is to provide said nozzle grommet with a capability of being made of different plastic materials.

these objects and other advantages of the present invention will become more fully apparent from the following detailed description when taken in conjunction with the accompanying drawings wherein:

DESCRIPTION OF THE PREFERRED EMBODIMENTS

The present invention relates to an emission opening in an underwater fluid emission system with a nozzle grommet of various sizes and shapes for use in said opening in the underwater fluid emission system, the grommet nozzle being made of plastic material and containing an antifoulant having a sustained antifoulant release capability sufficient to prevent calcareous marine organisms from forming within the opening containing the nozzle grommet.

The nozzle grommet of the invention is formed of a polymer or a mixture of polymers containing a material toxic to calcareous marine organisms and capable of release of the toxic material into the environment at such a rate that said marine organisms grow extremely slow, if at all on the nozzle grommet, yet not sufficiently fast to be a toxic hazard to the surrounding environment. One such polymeric material utilized in the invention is a mixture of polyvinylacetate and polyethylene containing thirty percent by weight of tri-n-butyltin fluoride.

The nozzle grommet of the invention can also be formed from any polymer-toxicant formulation which possesses the proper physical properties of viscosity and tensile strength required to maintain its shape and remain in position against the forces which tend to remove it, such as, air pressure, water flow and gravity and, provided the polymer-toxicant formulation is also capable of maintaining controlled release of the toxicant.

Illustrative toxicants (agents) capable of controlled release and as utilized in the invention are tri-n-butyltin oxide, tri-n-butyltin chloride, tri-n-butyltin carbonate, tri-n-propyltin fluoride, tri-n-butyltin fluoride, organoarsenic compounds, organophosphorus compounds, and organocopper compounds.

The generally preferred recipe for use in preparing the nozzle grommet of the invention are as follows:

| MATERIAL | % |
|---|---|
| Ethylene Vinyl Acetate Copolymer (EVA) | 20.0–30.0 |
| Low Density Polyethylene (LDPE) (MN 718, Exxon Co.) | 20.0–30.0 |
| Dispersent (Ca or Zn Stearate) | 0.5–2.0 |
| Porosigen ($CaCO_3$,$SiO_2$, $(NH4)_2$,$SO_4$.) | 10.0–25.0 |

-continued

| MATERIAL | % |
|---|---|
| Agent (Tri-n-butyltin fluoride TBTF) | 20.0–35.0 |

The two polymers are necessary to increase the interstitial free volume and the material used as the porosigen.

A specific and preferred recipe for use in preparing the nozzle grommet of the invention are as follows:

| MATERIAL | % |
|---|---|
| Ethylene Vinyl Acetate Copolymer (EVA) (MU 733, by ICI Corporation) | 22.0 |
| Low Density Polyethylent (LDPE) (MN 718, Exxon Corporation) | 22.0 |
| Zinc Stearate | 1.0 |
| $CaCO_3$ | 25.0 |
| Tri-n-butyltin fluoride (TBTF) | 30.0 |

Examples of other polymers or mixtures of other polymers serve as a containing and releasing matrix for the toxicant material are organotin-containing polysiloxane polymers, organotin-containing acrylic polymers, and organotin-containing epoxy polymers.

Figure 2B:
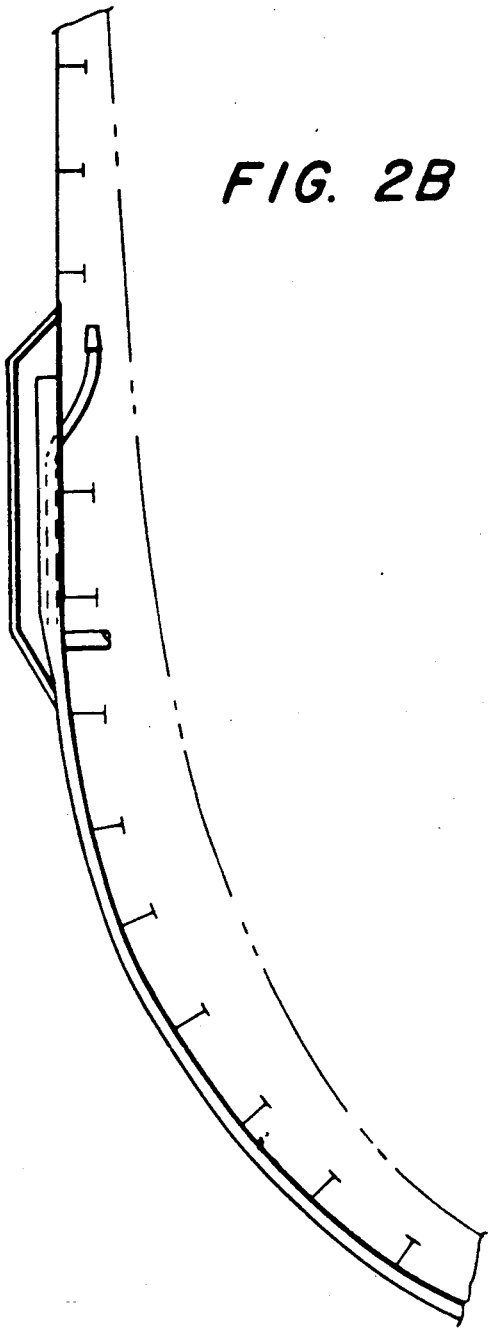
FIG. 2A and FIG. 2B illustrate individual holes within an underwater fluid emission system and said system's attachment to a waterborne device or apparatus of the invention.
Figure 2A:
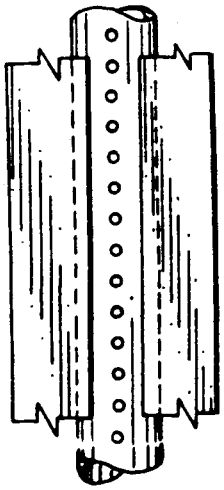

The preferred size of the fluid emission holes as illustrated in FIG. 2 is such that a free flow of fluid is capable of being maintained substantially at all times. The preferred surface is a smooth surface.

Figure 1A:
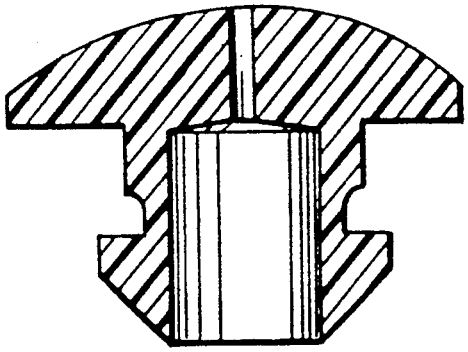
FIG. 1A, FIG. 1B, and FIG. 1C illustrate a one piece nozzle grommet in detail as used in this invention.
Figure 1B:
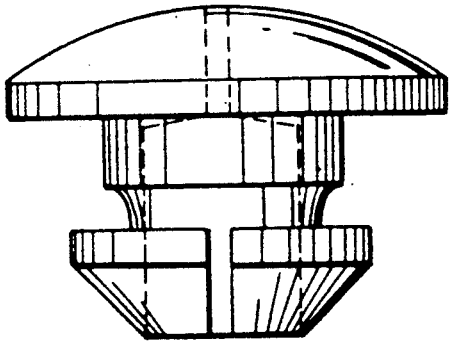
Figure 1C:
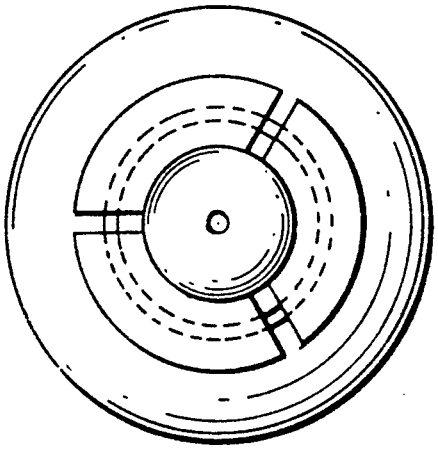
Figure 3A:
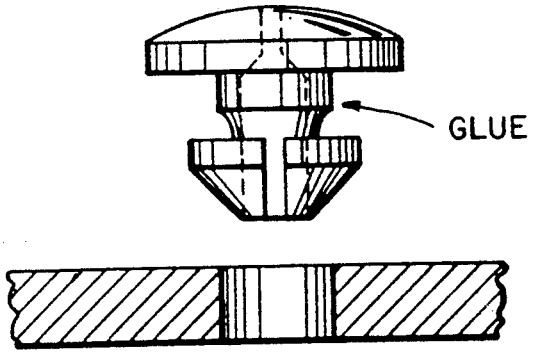
FIG. 3A, FIG. 3B and FIG. 3C illustrate the installation procedure of the nozzle grommet into the opening of the underwater fluid emission system of the invention.
Figure 3B:
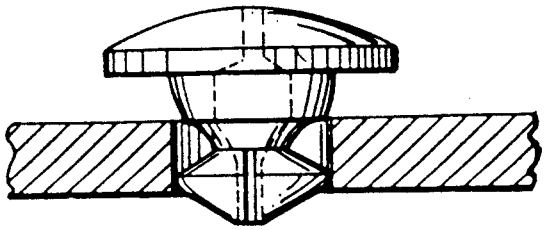
Figure 3C:
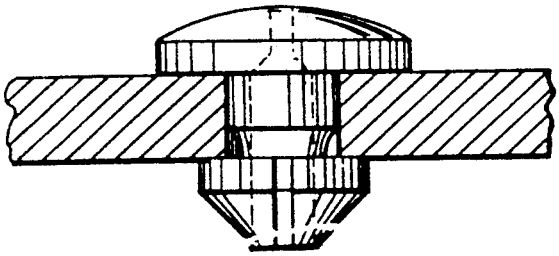

The nozzle grommet as illustrated in FIG. 1 is inserted into each hole of the underwater fluid distribution emission system as shown in FIG. 3. A small quantity of a glue, preferably an epoxy resin type that is capable of adhering to wet surfaces, is applied around the body of the nozzle grommet as shown in FIG. 3 in order to improve the seal between the nozzle grommet and the wall of the hole opening in the underwater fluid distribution emission system and to assist in retaining the nozzle grommet in place.

In operation, while the equipment with the nozzle grommet of this invention is in the water, the agent toxic material incorporated into the nozzle grommet is released slowly into the boundary layer of water at the nozzle grommet water interface, thus rendering this layer of water toxic to the marine organisms and preventing them from settling upon the nozzle grommet surface in almost all instances or killing them should they settle there.

In one example, it was observed that the nozzle grommet of this invention remained free of calcareous marine organisms after more than eighteen months while the fluid distribution emission system was kept underwater. The improved nozzle grommet of the invention greatly prolongs the functional life of the underwater fluid distribution emission system. Such prolonged systems functioning results in a great reduction in the frequency of maintaining the system by periodic removal of accreted calcareous marine fouling.

The grommet nozzles of the invention can be appropriately prepared and installed in existing underwater fluid distribution emission systems of varying sizes and shapes thus assisting in the control of volume rate of fluid flow required.

Obviously many modifications and variations of the present invention are possible in light of the above teachings. It is therefore to be understood that within the scope of the appended claims the invention may be practiced otherwise than as specifically described.

What is claimed is:

1. In an underwater environment, fluid distribution emission system having perforations and replaceable nozzle grommet appropriately positioned therein for emitting a fluid; the improvement comprising a toxin-containing antifouling polymer nozzle grommet in each of a plurality of perforation within the system formed of a mixture of polymers containing a material toxic in calcareous marine organisms and capable of controlled release of the toxic material into the environment at such a rate that calcareous marine organisms grow very slowly, if at all, on the nozzle grommets yet insufficiently fast to be a tixic hazard to the environment.

2. In an underwater fluid distribution emission system as in claim 1 wherein the mixture of polymers of the toxin-containing antifouling polymer nozzle grommets are selected from the group consisting of tri-n-butyltin oxide, tri-n-butyltin chloride, tri-n-butyltin carbonate, tri-n-butyltin fluoride, tri-n-ethyltin fluoride, organoarsenic compounds, organophosphorous compounds, organocopper compounds, organotin polisiloxane polymers, organotin acrylic polymers, polyvinylacetate, polyethylene and organotin epoxy polymers.

3. In an underwater fluid distribution emission system as in claim 2, wherein the mixture of polymers of the toxic containing antifouling polymer nozzle grommets are a mixture of polyvinylacetate and polyethylene and containing about thirty percent by weight of tri-n-butyltin fluoride.

4. In an underwater fluid distribution emission system as in claim 3 wherein the nozzle grommets are of various geometric sizes and shapes and are of a one piece design.

5. In an underwater fluid distribution emission system as in claim 3 wherein the nozzle grommets are of various sizes and shapes and are of a multiple piece design.

6. In an underwater fluid distribution emission system having replaceable nozzle nozzles grommets positioned therein for emitting a fluid the improvement comprising nozzle grommets being formed from polymer toxicant formulation possessing physical properties of viscosity and tensile strength required to maintain their shape and remain in position against forces which tend to dislodge it including air pressure, water flow and gravity and retaining a capability of maintaining a controlled release of the toxicant.

* * * * *